US007305782B2

(12) United States Patent
Olsen

(10) Patent No.: US 7,305,782 B2
(45) Date of Patent: Dec. 11, 2007

(54) PET TAG HOLDER

(76) Inventor: Sandra A. Olsen, 200 Leslie Dr., Hallandale, FL (US) 33009

( * ) Notice: Subject to any disclaimer, the term of this patent is extended or adjusted under 35 U.S.C. 154(b) by 142 days.

(21) Appl. No.: 11/376,037

(22) Filed: Mar. 15, 2006

(65) Prior Publication Data

US 2007/0214691 A1 Sep. 20, 2007

(51) Int. Cl.
*G09F 3/00* (2006.01)

(52) U.S. Cl. ..... 40/300; 40/303; 119/858

(58) Field of Classification Search ..... 40/300, 40/301, 302, 303, 304, 640, 658, 647, 659, 40/666, 655; 117/858; D30/155; 63/13, 63/3.1, 7; 24/645, 598.9, 599.9
See application file for complete search history.

(56) References Cited

U.S. PATENT DOCUMENTS 149,485 A * 4/1874 Kingman ..... 40/302
465,830 A * 12/1891 Bulova ..... 63/13
704,973 A 7/1902 Katz
983,598 A * 2/1911 Auerbach ..... 63/12
1,353,605 A 9/1920 Napolillo
1,539,744 A 5/1925 Kelly
1,803,196 A 4/1931 Mader
2,095,481 A 10/1937 Skopec
2,097,070 A 10/1937 Lago
2,125,768 A * 8/1938 Christensen et al. ..... 40/304
2,548,104 A 4/1951 Frison
2,648,150 A 8/1953 Sullivan
2,680,315 A 6/1954 McHugh
2,821,034 A 1/1958 Baker
2,880,701 A 4/1959 Foster
2,937,834 A 5/1960 Orenick
3,346,980 A 10/1967 Wallace
3,373,924 A 3/1968 Linda
3,461,586 A * 8/1969 Cannon, Jr. et al. ..... 40/300
3,481,528 A 12/1969 Leiter
3,729,780 A 5/1973 White
D243,411 S 2/1977 Johnson
4,259,798 A 4/1981 McConnell
4,309,797 A 1/1982 Schrougham
4,319,776 A 3/1982 Moberg
4,352,253 A 10/1982 Oswalt
4,512,093 A 4/1985 Kolton
4,739,566 A 4/1988 Smith
5,474,033 A 12/1995 Mitchell, Jr.
5,535,491 A 7/1996 Allport
6,314,625 B1 11/2001 Ikeda
6,598,326 B2 7/2003 Wikan
6,943,314 B2 9/2005 Kosted (Continued)

*Primary Examiner*—Gary C. Hoge

(57) ABSTRACT

Disclosed is a pet tag holder, namely a device for holding a pet tag on a pet collar. The pet tag holder comprises a planar, inverted "U-shaped" mounting member, for connection to a pet collar, and the mounting member further has two downwardly positioned extension arms in a plane perpendicular to the plane of the mounting member. One of the arms further comprises a post supported on a first mounting member and the other arm comprises a snap fit receptacle for the post on a second mounting member. One arm is fixed in space and the other arm is hinged to permit opening and closing of the post and receptacle. One or more pet tags can be held on the post, and secured to the tag holder when the post is engaged with the snap fit receptacle, the opening of the hinged arm also permits easy movement of the tag holder from one pet collar to another.

11 Claims, 3 Drawing Sheets

U.S. PATENT DOCUMENTS

2003/0033737 A1 2/2003 Bradshaw
2005/0199001 A1* 9/2005 Yozevitch ..... 63/12
2005/0247079 A1* 11/2005 Padeh ..... 63/13
2005/0268864 A1 12/2005 Gallagher

* cited by examiner

PET TAG HOLDER

BACKGROUND OF THE INVENTION

The present invention relates to means for attaching pet tags to pet collars and more particularly to a decorative holder adapted for attaching one or more tags which also permits easy transfer of the tags from one collar to another.

Domesticated pets such as dogs and cats are generally required by statute to be licensed and vaccinated. Tags indicating the payment of license fees and appropriate vaccination are required to be attached to the pet's collar to indicate that the statutory requirements have been complied with. In addition most pet owners choose to provide at least one additional tag carrying identifying information such as the owner's name and address and the pet's name to aid in recovery of the pet if it should be lost. Thus at least two and sometimes three tags are attached to the pet's collar. These tags are generally made of some type of metal to provide the desired strength and durability.

One common tag holders is the metal "S" hook, in which one end of the hook is clamped to the collar—using either the common D-ring or another part of the collar as the attachment point; and the other end is clamped to the tag or group of tags to be attached to the collar. Other tag attachment devices include wire, split rings, and cable ties, (to name but a few), which can be used to lock one or more tags to a portion of the collar. All of these attachment devices are somewhat permanent. Once the tags are put in place on a collar using these devices, the tags are rarely removed. This is especially true for devices that deform or are destroyed during removal. Thus, when the pet owner wants to change collars, e.g., when the current collar becomes dirty or too small for the user, a new tag holder is often required. The present invention is a solution to this problem, by providing a pet tag holder that can easily go from collar to collar to collar.

INFORMATION DISCLOSURE

A search was conducted on this invention in Class/Subclass Numbers; 119/585 & 863; 40/27.5, 300, 303, 640 & 669; D30/152 & 159; 70/459; 24/559 & 576.1. The following documents were found:

U.S. Pat. No. 704,973 which provides a garment-clasp, comprising a clasp body made of spring metal doubled upon itself to form an eye and having its arms of approximately equal length and width extended from the eye in contiguity with each other, said arms curved in opposite directions and one of them offset near its central portion, one of the spring-arms of the clasp-body being formed with an aperture near its extremity, a stud on the opposite spring-arm arranged for traversing said aperture, which stud is of conical form with a rounded apex, a clamp slidingly mounted on the spring-arms and arranged to compress said arms in a forward movement of the clamp and a spring-tongue fixed to one face of one of the spring-arms and extended toward the opposite arm when the device is open, the end of said spring-tongue being back of and below the apex of said stud, said spring-tongue serving as an abutment to limit the entrance of a garment or fabric between the spring-arms.

U.S. Pat. No. 1,353,605 which provides a check holding device comprising a body portion, an upstanding hook secured thereto, and a spring guard secured to the body portion and having a longitudinally curved end portion, said end portion having a longitudinal slot formed therein and spaced from the free end of the same, said slot receiving the end portion of the hook with the free end of the hook extending outwardly beyond the longitudinally curved end portion and the free end of such longitudinally curved end portion extending inwardly beyond the hook.

U.S. Pat. No. 1,539,744 which provides a device comprising an outer casing having a display opening through its top wall, and an inner member fitting into said casing and having lateral flanges for confining between the same and the top wall of the casing a license plate, the casing and the inner member being provided at their ends with registering openings for reception of a collar strap.

U.S. Pat. No. 1,803,196 which provides an animal collar, a band, an identification plate, a pair of end members fixed to said band beyond the ends of said plate, and detachable connections between the extreme end portions of said plate and said end members, whereby said plate may be readily removed and replaced.

U.S. Pat. No. 2,095,481 which provides an identification card, a device for attaching said card to the wearing apparel of a person and comprising, a substantially U-shaped strip of resilient material, and means adjacent one end of said strip for attaching the card to said end for rotation thereon in different positions, said end being outwardly bent to bear against the card and fricitionally oppose rotation thereof, the ends of said strip being provided with cooperating devices for detachably attaching the same together to form a loop for attachment of the device to said wearing apparel.

U.S. Pat. No. 2,097,070 which provides a device of the class described, comprising a channel shaped body, a collar strap with openings in both ends and having its ends overlapping and passing through said body, a stud mounted on one end of the base of said body and projecting through certain of said openings, an element mounted on the other end of said body to which a leash may be attached, and a license plate on said overlapping ends and having one end engaged beneath said element and having its other end formed with an opening engaging said stud, and a lock on said stud.

U.S. Pat. No. 2,548,104 which provides a tag or the like, comprising a strip having adjacent one end a pin and adjacent the opposite end a receiver for said pin, said pin being insertable in said receiver and said pin and receiver having cooperating attaching and locking means constructed and arranged so that said pin is removably attached to said receiver when inserted therein a predetermined distance and locked in said receiver when inserted therein a further predetermined distance in the same direction.

U.S. Pat. No. 2,648,150 which provides a tag mounting for a flexible member such as for dog and cat collars, comprising a rigid tag supporting plate, means mounting said tag supporting plate on said flexible member, tag means and means for removably mounting said tag means on said tag supporting plate comprising a plurality of key hole slots having enlargements, said slots extending through said rigid tag supporting plate and a plurality of tag rivets extending through the tag means and engaging in said key hole slots, the spacing of said tag rivets being the same distance as the distance between said enlargements of said key hole slots.

U.S. Pat. No. 2,680,315 which provides a license or tag holder for mounting on straps or the like comprising a rectangular sheath for passing over a strap, said sheath having a wall of transparent material and having the opposite wall indented inwardly to grippingly engage the strap, and a slide for said sheath comprising a U-shaped member for receiving the tag, the legs of the U-shaped member being spaced a distance greater than the length of the sheath to interlock with the ends of the sheath when assembled between the strap and transparent wall of the sheath and said legs being of a height corresponding to the spacing between the walls of the sheath to pass through said sheath to interlock with the ends of the sheath when the strap is inserted below the U-shaped member.

U.S. Pat. No. 2,821,034 1. which provides an identification device for livestock comprising a linked chain adapted to be passed about the neck of a livestock animal, a connector link joining the end links of said chain, and a planar identification tag having indicia on both sides thereof and having a perforation through which said connector link is threaded, said connector link comprising a U-shaped body member formed of resilient wire and having approximately parallel side arms, each of said side arms being offset outwardly adjacent its free end to form a bight in which one of the end links of said chain is engaged, and the free end portions of said side arms being formed respectively to present an eye and an outwardly opening hook, and a fastener link pivoted in said eye and operable to be moved into engagement with said hook only when said side arms are urged resiliently closer together.

U.S. Pat. No. 2,880,701 which provides a cat and dog identification band comprising, in combination, a yieldable annular ring, a plurality of beads slidably supported upon said ring, a tag slidably supported upon said ring in overlying relationship with a plurality of said beads, said tag having identification means for locating the owner of the animal wearing said band, said annular ring comprising an elongated tension spring and a shorter tension spring, said elongated tension spring being of larger diameter than said shorter tension spring, and said shorter tension spring connecting the ends of said elongated spring together to form said ring, and each end of said shorter tension spring being engaged within one of the ends of said elongated spring.

U.S. Pat. No. 2,937,834 which provides a panel wall having a hole there through, an electric cable fastener, comprising, a substantially flat flexible strap having anchor and lock elements, formed integral therewith, positioned at opposite ends and sides thereof and adapted to be brought into apposition by flexing the strap upon itself, the anchor element comprising a conical head mounted on a cylindrical stem, the diameter of the base of the head being greater than that of the panel wall hole, the diameter of the stem being less than that of said hole, the head and stem having an axial bore therethrough normal to and through the long axis of the strap, the head having a counter-bore therein defining an abutment positioned proximate the base thereof, the head and stem also having a diametric slot dividing them into two identical halves free to flex on the strap, toward or away from each other, the lock element comprising a solid conical head mounted on a cylindrical stem, the diameter of the base of the head being greater than that of the anchor element bore and counterbore, the stem being of smaller diameter than said bores, the anchor stem being positioned through the panel wall hole with the base of its conical head positioned against the opposite side of the wall, the conical lock head being nested within the anchor head counterbore against the abutment thereof, whereby the halves of the anchor head are flexed away from each other to permanently lock both interfitted elements against removal through the panel wall hole and with the flexed strap forming a cable supporting loop.

U.S. Pat. No. 3,346,980 which provides a tag with a base support portion attached in substantial face to face engagement with the ear of a head of livestock by a clinched metal loop, the tag also including an upstanding portion bearing an identifying indicium thereon.

U.S. Pat. No. 3,373,924 which provides a handle to assist in carrying, moving and pouring from paperboard containers, in which the handle is constructed from a single loop of material provided with a horizontal hand grip side, two vertical sides respectively attached to the two ends of the hand grip side, and two inwardly sloping sides, each of which is attached at one end to a respective one of the vertical sides at a selected acute angle, and each of which terminates at the other end in an element of a closure mechanism, the length of each sloping side and said acute angle being selected to bring said ends of said sloping sides which terminate in closure mechanism elements into contact with one another.

U.S. Pat. No. 3,481,528 which provides a handle to assist in carrying, moving and pouring from paperboard containers, in which the handle is constructed from a unitary loop of thermoplastic material having a plurality of co-planar sides of inverted T-shaped cross section in which the cross bar of the T forms the interior of the loop, one of said sides forming the hand grip of said handle, two other sides respectively attached to the two ends of the hand grip side, and two inwardly sloping sides, each of which is attached at one end to a respective one of the vertical sides at a selected acute angle, and each of which terminates at the other end in an element of a closure mechanism, one of said elements being shaped to resemble a cone with a rounded apex.

U.S. Pat. No. 3,729,780 which provides a clamp having discs carried at opposed ends of a foldable connecting strap, one of said discs carrying a projecting pointed penetrating shaft, the other of said discs carrying a shaft receiving sleeve, and interengaging means between the shaft and sleeve to secure the opposed discs in folded clamping position.

U.S. Pat. No. 4,259,798 which provides a holder for supporting a pair of pet tags while preventing rattling therebetween comprising an elongated base member having means at one end for connection to a pet collar and carrying a post on a second end for engaging a hole in pet tags. A pair of spring arms are carried by the base member and have free ends spaced in opposition about the post to urge the tags against the base member to thereby prevent rattling. In a preferred form the base member comprises a flat plate having dimensions comparable to a pet tag and providing a surface for carrying identifying indicia.

U.S. Pat. No. 4,309,797 which provides a coupler for animal collars characterized by a novel combination of a releasable locking member in the form of a strip of metal which conveniently functions as a name plate. This strip is adapted to receive a pair of post members provided on a channel-like base member which in turn receives respective ends of the collar which are held on the posts until the strip member is removed. One of the posts includes a stop means and the other post is a threaded member adapted to receive a complementary threaded member disposed through spaced holes in the locking strip to effectively couple the ends of the collar together. Merely removing the threaded member from the threaded post permits quick removal of the strip from both posts.

U.S. Pat. No. 4,319,776 which provides a security seal formed of a single piece of molded plastic in which a socket member and a stud member intended for locking engagement are disposed on the ends of legs so mounted on a base that the seal may be closed by squeezing the legs together with the fingers of one hand so that the socket and stud lock together. An additional bowed member extends between the legs, which flexes when the legs are squeezed together, providing additional spring back force to cause the stud and socket to separate if not completely locked together. The additional bowed member also which provides additional aligning force to insure that the stud and socket are properly aligned for engagement when squeezed together.

U.S. Pat. No. 4,352,253 which provides an animal marking system for cattle and the like comprises a flexible strap (14) designed to be secured around the neck of an animal. One set of patches (22) bearing numbers and another set of patches (20) bearing a color are replaceably secured at two separate locations to the strap (14) so that the numbers and colors are clearly visible from a distance and from each of the two sides of the animal. The system includes sets of patches (20) bearing different identifiable colors to indicate the condition of the cow with respect to health, breeding condition or lactation. The patches are secured to the sides of the strap through a Velcro fastening system.

U.S. Pat. No. 4,739,566 which provides a holder for pet tags which is attached to a typical pet collar. To prevent the tags from rattling, the holder has a flexible extension which secures on the tags when the holder is folded around the tags. The holder has flaps folded over the tags to give a neat appearance and to enclose and further secure the tags. The tags are secured to the holder by attachment utilizing the hole provided in the tag such as a screw. The holder is compact and fits neatly on the collar.

U.S. Pat. No. 4,512,093 which provides an article identification tag has a tag body portion and a tag tie extending integrally from the tag body part. The tag tie has, at its end, a latch projection for retention in a latch opening formed in the tag body part, adjacent an identifier expanse on the tag body part. Configuration of the tag interfitting components is such that essentially no grippable surface is presented in the vicinity of the latched components upon looping of the tie through an article and securement of the tag components.

U.S. Pat. No. 5,474,033 which provides a device for amusing animals and teaching animals not to chew on undesirable objects such a furniture and clothing comprises a chewing device suspended from the neck of the animal. The animal will choose the suspended device to chew. The chewing device may be flavored. Medication may also be administered through the device.

U.S. Pat. No. 5,535,491 which provides a fastener for retaining an article to an object, such as a ski pass hang tag to a ski jacket, said fastener comprising a body having first retaining means to non-releasably retain said article and second retaining means to non-releasably retain said object. Preferably the fastener is of unitary construction and formed of a resiliently flexible material such as nylon. The fastener which provides for improved security, convenience, reduced litter and for the display of advertising material.

U.S. Pat. No. 6,314,625 which provides a zipper handle structure is formed of an attaching member to be swingably attached to a slider main portion of a zipper and having an opening and a side portion, a handle member having a through hole at one side, and a connecting member for connecting the attaching member and the handle member. The connecting member includes a first end portion with an engaging shaft, a second end portion with an engaging hole to be detachably engageable with the engaging shaft, and a center portion between the first and second end portions. When the connecting member connects the attaching member and the handle member, the first and second end portions are overlapped to engage the engaging shaft with the engaging hole, while the side portion of the attaching member is held between the first and second end portions adjacent the center portion and the engaging shaft is located in the through hole of the handle member. The handle member is swingably connected to the attaching member. In this structure, a user can easily exchange the handle member with a new one as desired, an attaching strength can be easily strengthened, and the shape and thickness of the handle member have no regulations.

U.S. Pat. No. 6,598,326 which provides a livestock tag locking system device, including a male component (1) and a female component (8), wherein the male component (1) has a face (3) onto which indicia may be applied and a stem (4) equipped with a tip (5). The stem (4) is made of a relatively soft plastic material and the tip (5) is made of a relatively hard plastic material. The female component has a cup portion (11) equipped with a retaining ring (14). The cup portion (11) is made of a relatively soft plastic material and the retaining ring (14) is made of a relatively hard plastic material.

U.S. Pat. No. 6,943,314 which provides a method for making a double sided, metal Rabies I.D. tag with an electronic engraving machine capable of inscribing data on both sides such as one side of the I.D. tag has inscribed personal contact information along with the name of the pet, and the other side has inscribed the rabies vaccination information.

U.S. Design Pat. No. 243,411 which provides the ornamental design for an animal collar or similar article.

U.S. Publication No. 2003/0033737 which provides a holder for securing, silencing and protecting pet tags to a typical pet collar is provided. The holder includes an opening at one end allowing insertion of pet tags therein and an attachment opening allowing attachment therethrough of pet tags to a pet collar. In the preferred embodiment the holder is made of a flexible material allowing insertion of multiple tags and tags larger than the opening.

U.S. Publication No. 2005/0268864 which provides a pet collar with quick-release tag fastener allowing for easy attachment and removal of pet identification tags to collars, wherein the pet tags are releasably attachable without requiring the use of any tools for securing and/or releasing the tags from the fastener and/or the collar.

The disclosures of each of these prior art documents are hereby incorporated herein by reference.

SUMMARY OF THE INVENTION

Accordingly an object of the present invention is to provide a pet tag holder for supporting one or more pet tags from a pet's collar which also permits easy transfer of the holder from one collar to another.

Another object of the present invention is to provide a pet tag holder which may be used as a support for indicia—for example, identifying the pet, identifying the owner, or simple artistic expression, such as "pet jewelry."

These and other objects of the present invention are achieved by providing a pet tag holder comprising a base member having attachment means on one end for connection to a pet collar, In an especially preferred embodiment, the present invention is directed to a pet tag holder for supporting a pet tag from a pet collar comprising:

a planar, inverted "U-shaped" mounting member, for connection to a pet collar, said mounting member further having two downwardly positioned extension arms in a plane perpendicular to the plane of the mounting member, wherein one of the arms further comprises a post supported on a first mounting member and the other arm comprises a snap fit receptacle for the post on a second mounting member;

wherein one arm is fixed in space and the other arm is hinged to permit opening and closing of the post and receptacle;

wherein one or more pet tags can be held on the post, and secured to the tag holder when the post is engaged with the snap fit receptacle; and wherein the opening of the hinged arm also permits easy movement of the tag holder from one pet collar to another.

BRIEF DESCRIPTION OF THE DRAWINGS

The present invention may be better understood by reading the following detailed description of the preferred embodiment with reference to the accompanying drawings wherein.

DESCRIPTION OF THE PREFERRED EMBODIMENTS

As described above, the present invention is directed to a pet tag holder, a device for holding a pet tag on a pet collar. The preferred pet tag holder comprises a planar, inverted "U-shaped" mounting member, for connection to a pet collar. Given that different collars have different sized mounts for pet tag holders, the "U-shaped" mounting member (and the remainder of the tag holder) is selected in an appropriate size for a given collar—e.g., small, medium, large, and extra-large. The mounting member further has two downwardly positioned extension arms in a plane perpendicular to the plane of the mounting member. One of the arms further comprises a post supported on a first mounting member and the other arm comprises a snap fit receptacle for the post on a second mounting member. One arm is fixed in space and the other arm is hinged to permit opening and closing of the post and receptacle. One or more pet tags can be held on the post, and secured to the tag holder when the post is engaged with the snap fit receptacle, the opening of the hinged arm also permits easy movement of the tag holder from one pet collar to another.

With reference now to the figures accompanying this disclosure, a preferred embodiment of the present invention is shown in exploded view—and collectively the two parts of the tag holder are designated by reference number (10).

The pet tag holder (10) in the preferred embodiment is constructed from two main parts, which link together to form a unitary structure. In the illustrated embodiment, these parts are preferably made from metal—and formed by casting, molding, machining, or similar metal forming and assembly techniques. Such techniques are well known. In the current embodiment, the two main parts can be formed as cast pieces of either brass or zinc aluminum. The hinge is preferably a pined hinge and the snap-fit clasp has the shape of a conventional clothing snap. The post and clasp can either be formed when the two pieces are formed, or these pieces can be added to the main parts, for example by spot welding or similar attachment techniques. The completed tag holder, or the individual parts, can further be provided with a variety of colors by plating techniques (electroplating, electroless plating, and the like) to provide a surface finishes of gold, rhodium, silver, or the like, to give a desired jewelry-like appearance.

Alternatively, other materials, including mixtures of materials, could be employed for the manufacture of this holder. For example, plastics could be used for a portion or all of the component parts described herein. Tough plastics are well known and readily available, and these too can be converted into the pet tag holder by molding, machining, or similar plastics forming and assembly techniques. Such techniques are well known.

Figure 4:
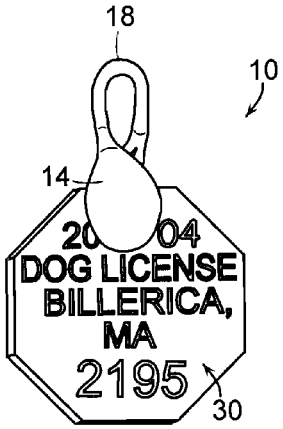
FIG. 4 is a front view of a preferred embodiment of the present invention showing a pet tag in place on the tag holder.
Figure 5:
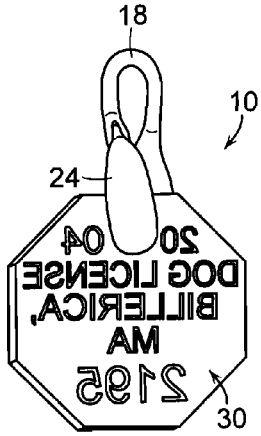
FIG. 5 is a back view of a preferred embodiment of the present invention showing a pet tag in place on the tag holder.
Figure 6:
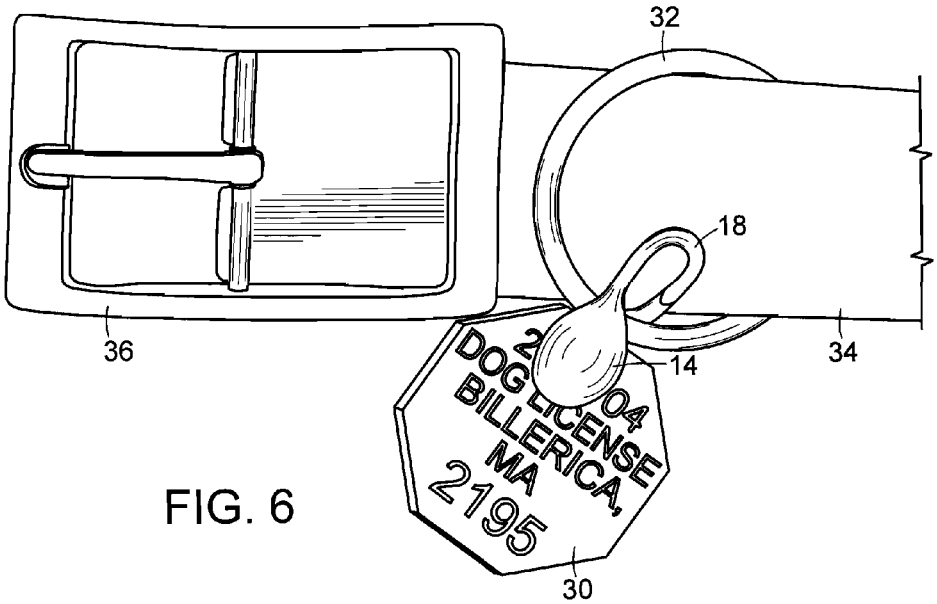
FIG. 6 is a front view of a preferred embodiment of the present invention showing a tag in place on the tag holder on a pet collar.

As shown in FIGS. 1-6, the preferred tag holder (10) comprises a planar, inverted "U-shaped" mounting member (18), for connection to a pet collar (34). In FIG. 6, the "U-shaped" mounting member (18) is a bit small for the collar illustrated. A larger unit would be preferred for this particular pet collar, as it would fit better.

Figure 2:
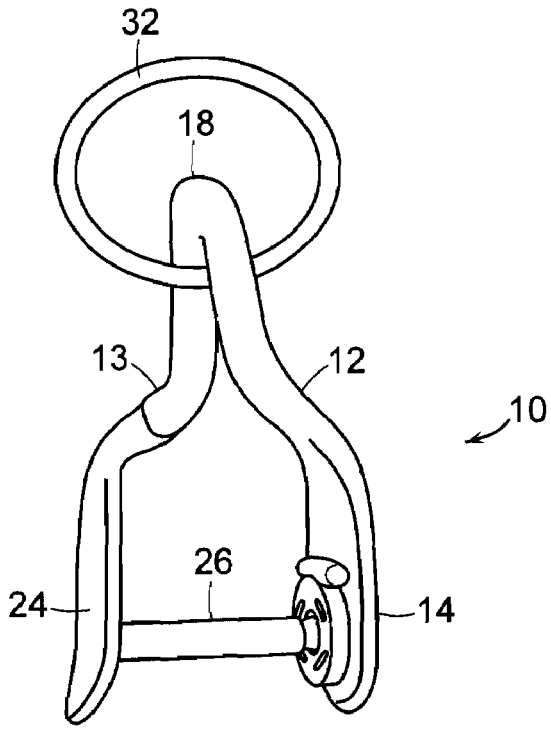
FIG. 2 is a side view of the FIG. 1 embodiment showing the tag holder in the closed position.
Figure 3:
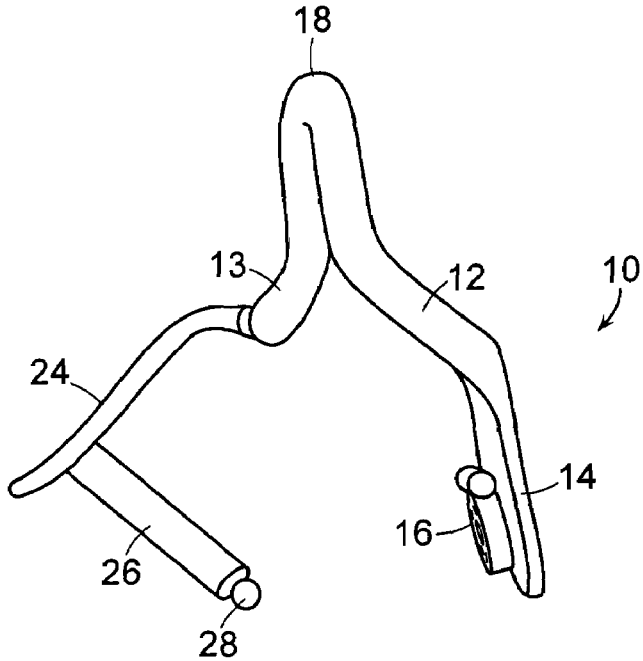
FIG. 3 is a side view of the FIG. 1 embodiment showing the tag holder in the open position.

As best shown in FIGS. 2 and 3, mounting member (18), which is designed to fit onto an appropriate part of the pet collar—here designated as reference number (32), further has two downwardly positioned extension arms (12) and (13) in a plane perpendicular to the plane of the mounting member (18).

One of the arms (13) further comprises a post (26) supported on a first mounting member (24) and the other arm (12) comprises a snap fit receptacle (16) for the post tip (28) on a second mounting member (14).

Figure 1:
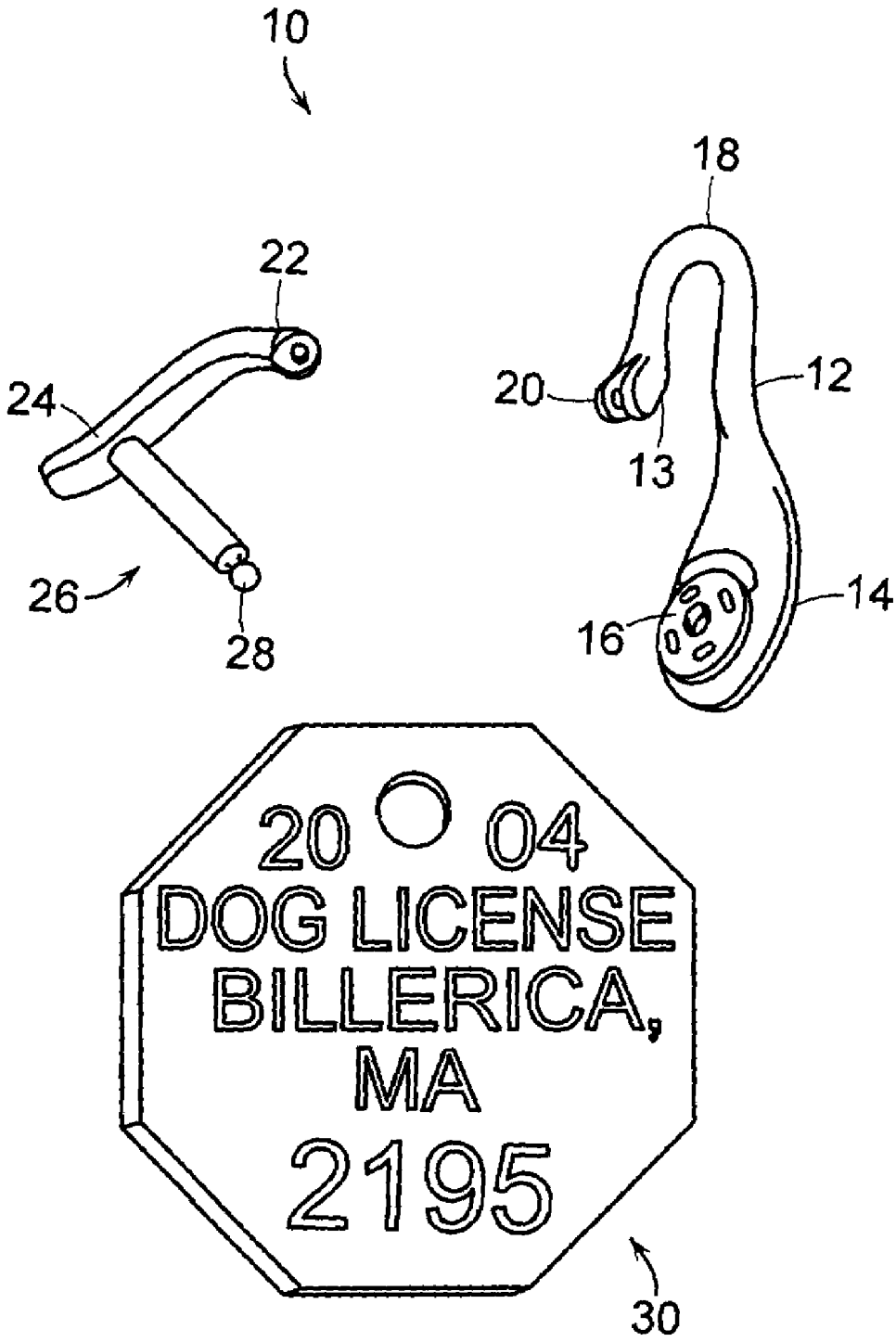
FIG. 1 is a plan view of the preferred embodiment showing the two parts of the preferred tag, and one tag to be held thereby.

As best illustrated in FIGS. 1 and 3, one arm (12) is fixed in space and the other arm (13) includes hinge members (20) and (22) to permit opening and closing of the post tip (28) and receptacle (16). This permits easy addition and/or removal of pet tags (30) from the holder (10) and also permits easy movement of the holder (10) from one collar (34) to another (not shown).

FIGS. 4, 5 and 6 best illustrate another aspect of the present invention, namely the decorative aspect of the tag holder (10). When in use on a pet collar (34), tag holder (10) is preferably provided with a decorative outer surface on mounting member (14). FIGS. 4 and 6 show one such decorative surface for mounting member (14). FIG. 5 shows that a decorative surface can also be employed for the second mounting member (24).

Although not illustrated in the Figures, the pet tag holder can further include an attachment device, e.g., on mounting member (14), for holding replaceable user selected attachment members. Such attachment devices or members would be additional decorative devices, such as letters of the alphabet, signs of the Zodiac, jewels, team logos, automobile logos, motorcycle logos, photograph holders, and the like. This feature would permit the pet owner to modify the look of the pet tag holder for any occasion. Suitable attachment devices include hook and loop fasteners, snap clips, grip hooks, and the like, which permit another decorative device to be attached to the mounting member (14), thereby changing the outward appearance of the holder.

The present invention has been described in detail, including the preferred embodiment thereof. However, it will be appreciated that those skilled in the art, upon consideration of the present disclosure, may make modifications and/or improvements on this invention and still be within the scope of this invention as set forth in the following claims.

What is claimed is:

1. A pet tag holder for supporting a pet tag from a pet collar comprising:

a planar, inverted "U-shaped" mounting member, for connection to a pet collar, said mounting member further having two downwardly positioned extension arms in a plane perpendicular to the plane of the mounting member, wherein one of the arms further comprises a post supported on a first mounting member and the other arm comprises a snap fit receptacle for the post on a second mounting member;

wherein one arm is fixed in space and the other arm is hinged to permit opening and closing of the post and receptacle;

wherein one or more pet tags can be held on the post, and secured to the tag holder when the post is engaged with the snap fit receptacle; and wherein the opening of the hinged arm also permits easy movement of the tag holder from one pet collar to another.

2. The pet tag holder of claim 1, wherein said mounting member is metal.

3. The pet tag holder of claim 1, wherein said extension arms are metal.

4. The pet tag holder of claim 1, wherein said post and said snap fit receptacle are metal.

5. The pet tag holder of claim 1, wherein said mounting member is plastic.

6. The pet tag holder of claim 1, wherein said extension arms are plastic.

7. The pet tag holder of claim 1, wherein said post and said snap fit receptacle are plastic.

8. The pet tag holder of claim 1, wherein the first mounting member further comprises a decorative outer surface.

9. The pet tag holder of claim 1, wherein the second mounting member further comprises a decorative outer surface.

10. The pet tag holder of claim 1, wherein the first mounting member further comprises an attachment point for replaceable user selected attachment members.

11. The pet tag holder of claim 10, wherein the user selected attachment members are selected from the group consisting of letters of the alphabet, signs of the Zodiac, jewels, team logos, automobile logos, motorcycle logos, photograph holders, and the like.

* * * * *